US005391133A

United States Patent [19]

Ruffa

[11] Patent Number: 5,391,133

[45] Date of Patent: Feb. 21, 1995

[54] UNDERWATER BUOYANT EXERCISE APPARATUS

[76] Inventor: Anthony A. Ruffa, 10 Orchard St., Niantic, Conn. 06357

[21] Appl. No.: 84,464

[22] Filed: Jul. 1, 1993

[51] Int. Cl.[6] ..... A63B 21/00

[52] U.S. Cl. ..... 482/92; 482/107; 482/111

[58] Field of Search ..... 482/55, 92, 104, 106, 482/107, 108, 109, 110, 111; 441/56, 129; 403/353, 373

[56] References Cited

U.S. PATENT DOCUMENTS

| | | | |
|---|---|---|---|
| 2,009,551 | 7/1935 | Huebner | 441/56 |
| 3,231,270 | 1/1966 | Winer | 482/106 |
| 3,311,374 | 3/1967 | Wittenberg et al. | 482/106 |
| 3,334,899 | 8/1967 | Bosko et al. | 482/108 |
| 3,427,022 | 2/1969 | Ward | 482/111 |
| 3,781,007 | 12/1973 | Baker et al. | 482/106 X |
| 4,029,312 | 6/1977 | Wright | 482/108 |
| 4,089,528 | 5/1978 | Green | 482/106 |
| 4,103,887 | 8/1978 | Shoofler | 482/106 |
| 4,256,301 | 3/1981 | Goyette | 482/104 |
| 4,300,759 | 11/1981 | Caplan | 482/111 |
| 4,361,324 | 11/1982 | Baroi | 482/106 X |
| 4,639,979 | 2/1987 | Polson | 4 82/107 |
| 4,690,651 | 9/1987 | Samson et al. | 441/56 |
| 4,997,184 | 3/1991 | Sherman | 482/108 |
| 5,062,631 | 11/1991 | Dau et al. | 482/107 |
| 5,106,078 | 4/1992 | Rowe | 482/92 X |
| 5,242,349 | 9/1993 | Reiff et al. | 482/106 |
| 5,242,352 | 9/1993 | Elliott | 482/111 |
| 5,295,933 | 3/1994 | Ciminski et al. | 482/107 |

*Primary Examiner*—RIchard J. Apley
*Assistant Examiner*—John Mulcahy
*Attorney, Agent, or Firm*—Hugh E. Smith

[57] ABSTRACT

An exercise apparatus for providing resistance to a motion of a user. The apparatus is provided with a bar having a pair of buoyancy chambers which causes the bar to float. A user may exercise by submersing the apparatus in a body of water against a buoyant force provided by the chambers. An anchoring system for both the user and the apparatus is provided to secure a position thereof in the body of water. In addition, the chambers may be inflated by a pressurized gas canister contained within the bar. The buoyancy chambers are retained between collars and circumferential journals on the bar. Pivotally openable clasps engage the journals. Cylindrical retainers are positioned over the clasps to prevent the clasps from opening, thus retaining the buoyancy chambers on the bar.

5 Claims, 4 Drawing Sheets

UNDERWATER BUOYANT EXERCISE APPARATUS

BACKGROUND OF THE INVENTION

1. Field of the Invention

The present invention relates to exercise weights and more particularly pertains to an underwater buoyant exercise apparatus which may be utilized for providing resistance to a motion of a user when the apparatus is submersed in a body of water.

2. Description of the Prior Art

The use of exercise weights is known in the prior art. More specifically, exercise weights heretofore devised and utilized for the purpose of providing resistance to a motion of a user are known to consist basically of familiar, expected and obvious structural configurations, notwithstanding the myriad of designs encompassed by the crowded prior art which have been developed for the fulfillment of countless objectives and requirements.

For example, a wrist exerciser is illustrated in U.S. Pat. No. 5,037,087 which comprises a water filled container connected to a bar by a rope. The exerciser may be utilized by rotating the bar to roll the rope onto the bar and thereby lift and lower the bottle.

Another patent of interest is a swim weight sleeve system for use in aquatic exercises and training applications by swimmers as disclosed in U.S. Pat. No. 4,905,991. The system utilizes a weighted sleeve that is adapted to stretch over the hand or foot of a swimmer and retract to substantially its original size to provide a snug fit conforming to the shape of the forearm or calf of the swimmer.

A dumbbell provided with a weight at both end portions thereof is described in U.S. Pat. No. 4,021,040. The weight is detachable from the dumbbell so as to make it adjustable in weight in accordance to the weight dealing capacity of a trainee. The dumbbell has a handle and a threaded bar at each end thereof to allow for a rapid interchange of weights.

While these devices fulfill their respective, particular objectives and requirements, the aforementioned patents do not describe an exercise apparatus for providing resistance to a motion of a user when submersed in a body of water against a buoyant force provided therein.

In this respect, the underwater buoyant exercise apparatus according to the present invention substantially departs from the conventional concepts and designs of the prior art, and in so doing provides an apparatus primarily developed for the purpose of providing resistance to a motion of a user when submersed in a body of water against a buoyant force provided therein.

SUMMARY OF THE INVENTION

In view of the foregoing disadvantages inherent in the known types of exercise weights now present in the prior art, the present invention provides a new underwater buoyant exercise apparatus construction wherein the same can be utilized for providing resistance to a motion of a user. As such, the general purpose of the present invention, which will be described subsequently in greater detail, is to provide a new underwater buoyant exercise apparatus which has many of the advantages of the exercise devices mentioned heretofore and many novel features that result in a underwater buoyant exercise apparatus which is not anticipated, rendered obvious, suggested, or even implied by any of the prior art exercise devices, either alone or in any combination thereof.

To attain this, the present invention essentially comprises an underwater buoyant exercise apparatus for providing resistance to a motion of a user. The apparatus is provided with a bar having a pair of buoyancy chambers which causes the bar to float. A user may exercise by submersing the apparatus in a body of water against a buoyant force provided by the chambers. An anchoring system for both the user and the apparatus is provided to secure a position thereof in the body of water. In addition, the chambers may be inflated by a pressurized gas canister contained within the bar.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new underwater buoyant exercise apparatus which has many of the advantages of the exercise devices mentioned heretofore and many novel features that result in a underwater buoyant exercise apparatus which is not anticipated, rendered obvious, suggested, or even implied by any of the prior art exercise devices, either alone or in any combination thereof.

It is another object of the present invention to provide a new underwater buoyant exercise apparatus which may be easily and efficiently manufactured and marketed.

It is a further object of the present invention to provide a new underwater buoyant exercise apparatus which is of a durable and reliable construction.

An even further object of the present invention is to provide a new underwater buoyant exercise apparatus which is susceptible of a low cost of manufacture with regard to both materials and labor, and which accordingly is then susceptible of low prices of sale to the consuming public, thereby making such underwater buoyant exercise apparatus economically available to the buying public.

Still yet another object of the present invention is to provide a new underwater buoyant exercise apparatus which provides in the apparatuses and methods of the prior art some of the advantages thereof, while simultaneously overcoming some of the disadvantages normally associated therewith.

Still another object of the present invention is to provide a new underwater buoyant exercise apparatus which may be utilized for the purpose of providing resistance to a motion of a user when submersed in a body of water against a buoyant force provided therein.

Yet another object of the present invention is to provide a new underwater buoyant exercise apparatus which may be safely released by a user should the user not complete an exercise.

Even still another object of the present invention is to provide a new underwater buoyant exercise apparatus which allows a user to perform an exercise in a slow, controlled, motion, thereby providing a more beneficial exercise.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
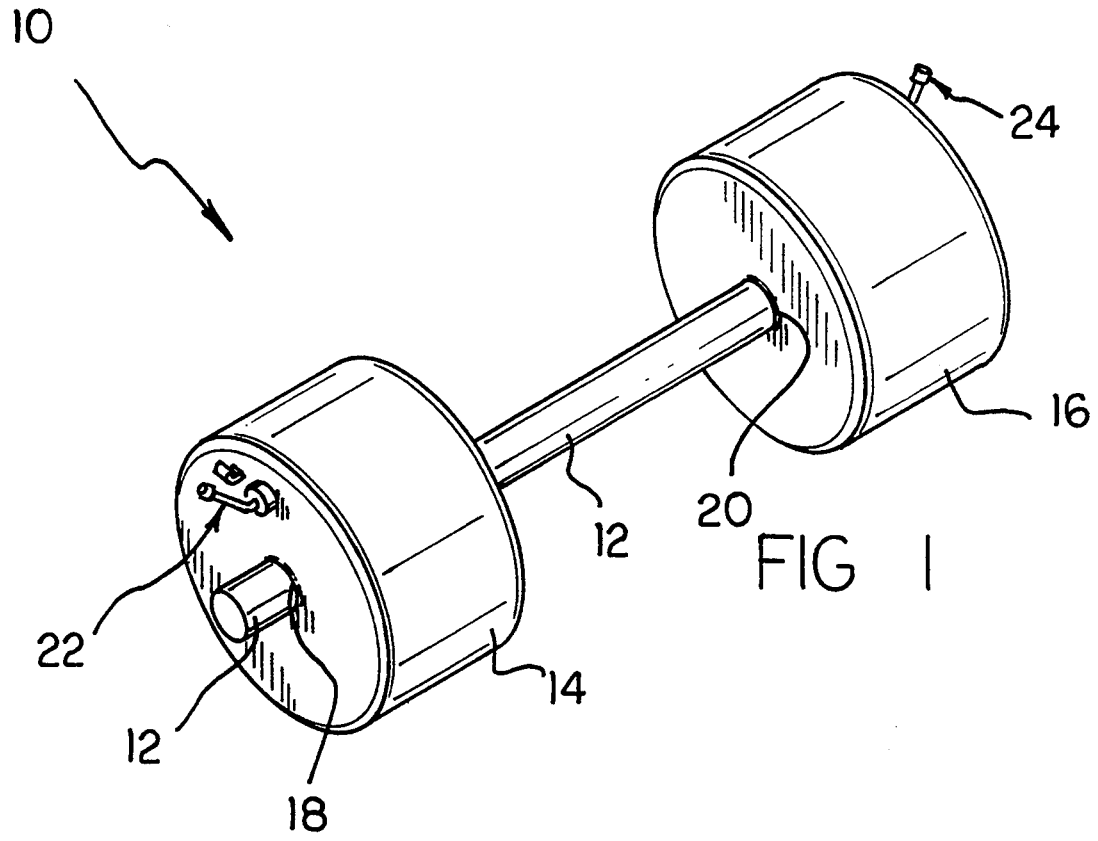
FIG. 1 is a perspective view of a first embodiment of an underwater buoyant exercise apparatus comprising the present invention.
Figure 2:
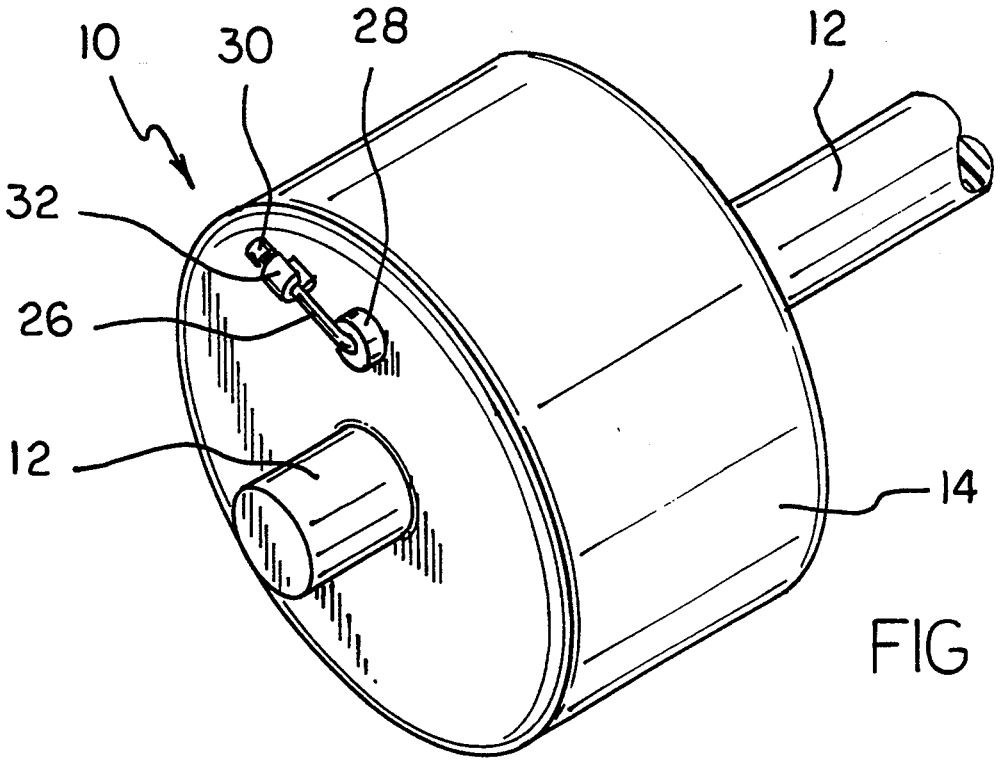
FIG. 2 is an enlarged view of a portion of the present invention.
Figure 3:
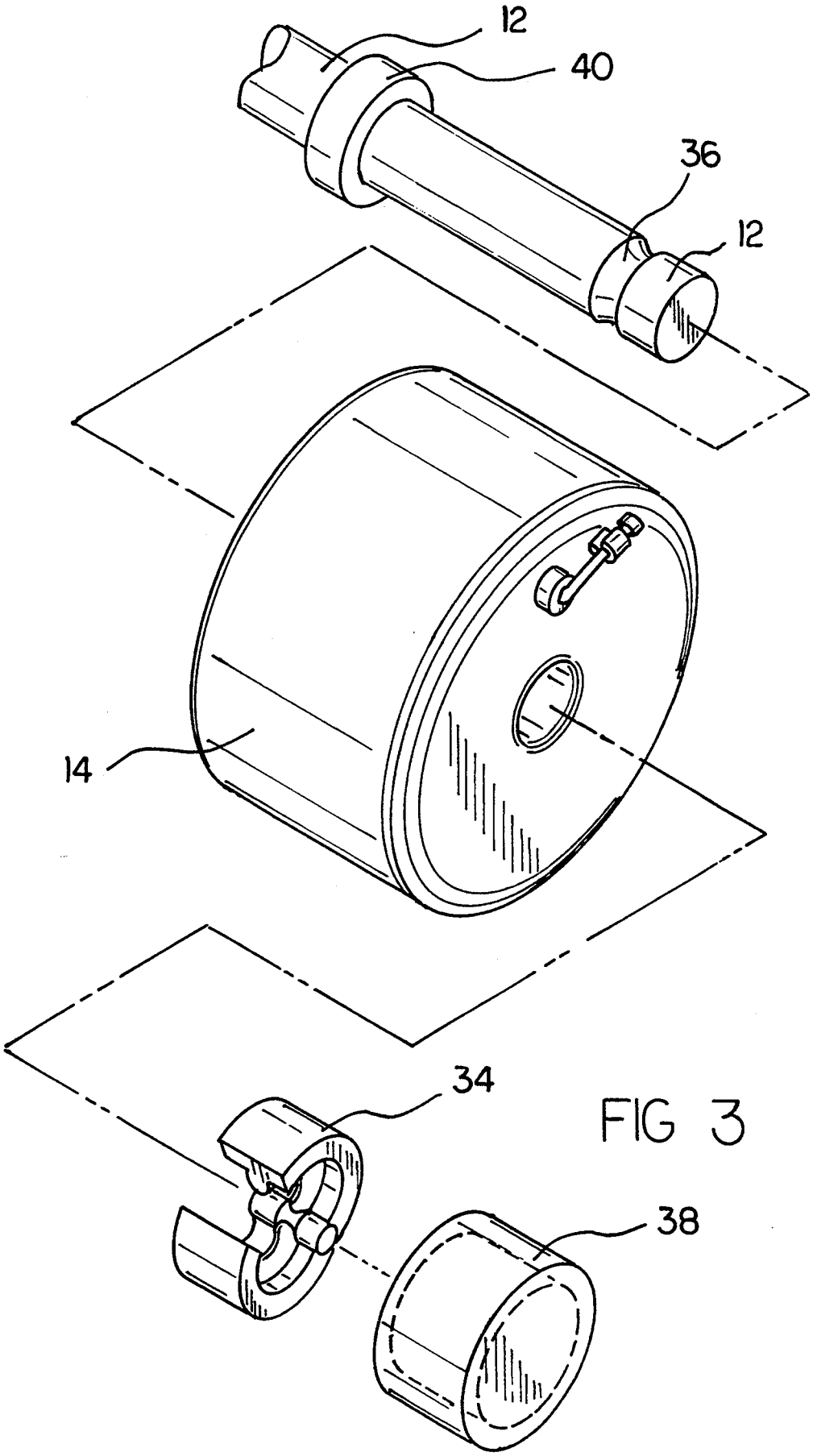
FIG. 3 is an exploded view of a portion of the invention.

With reference now to the drawings, and in particular to FIGS. 1–3 thereof, a new underwater buoyant exercise apparatus embodying the principles and concepts of the present invention and generally designated by the reference numeral 10 will be described.

More specifically, it will be noted that the underwater buoyant exercise apparatus 10 comprises an elongated bar 12 which may be held and manipulated by a user. A pair of buoyancy chambers 14, 16 are secured to respectively oppose ends (not labeled) of the bar 12 so that a user may grasp the bar between the buoyancy chambers in a well understood manner. Each of the buoyancy chambers 14, 16 is substantially cylindrical in shape and is provided with an air space (not labeled) therein. The buoyancy chambers 14, 16 are comprised of any material which may be utilized for containing a gas within the air space, preferably a material comprising a polyethylene laminate. The buoyancy chambers 14, 16 include respective apertures 18, 20 which pass through a center of the chambers to allow respectively opposed ends of the bar 12 to pass therethrough.

A pair of inflating assemblies 22, 24 are secured to the buoyancy chambers 14, 16 to allow an entrance of a gas into the chambers. The buoyancy chambers 14, 16 are retained upon the bar 12 by a radial compression of the apertures 18, 20 around the bar caused by pressure within the air space of each buoyancy chamber. The buoyancy chambers 14, 16 are substantially flexible and may be selectively inflated by a user through the inflating assemblies 22, 24 to substantially change a size of each buoyancy chamber, thereby increasing or decreasing buoyancy provided thereby. After selectively adjusting the buoyancy of the chambers 14, 16, a user may exercise a limb by submersing the apparatus beneath water.

The inflating assemblies 22, 24 are substantially similar in shape and function, and therefore only one will be described. The inflating assembly 22 is comprised of a stem 26 that is substantially hollow and tubular in shape. The stem 26 passes through a seal 28 in the buoyancy chamber 14 to provide fluid communication thereto. A connector 30 is located at an end (not labeled) of the stem 26 to facilitate connection of the stem to an air supply, such as a bicycle pump, or alternatively, a user's mouth. Fluid communication between the stem 26 and the air space within the buoyancy chamber 14 may be terminated by placing the stem 26 within a clip 32 which is fixedly secured to the buoyancy chamber 14 to clamp the stem 26, thereby effectively blocking fluid communication through the stem.

Each buoyancy chamber 14, 16 is frictionally engaged to the bar 12 by pressurized gas contained within each buoyancy chamber. The buoyancy chambers 14, 16 may be further secured to the bar 12 by the use of a clasp 34 which is operable to engage a journal 36 located at respectively opposed ends (not labeled) of the bar 12. A retainer 38 may be placed over the clasp 34 to further secure the clasp to the bar 12. A collar 40 is located on an opposite side of the buoyancy chambers 14, 16 of the bar 12 to prevent an axial translation of the buoyancy chambers along the bar.

Figure 4:
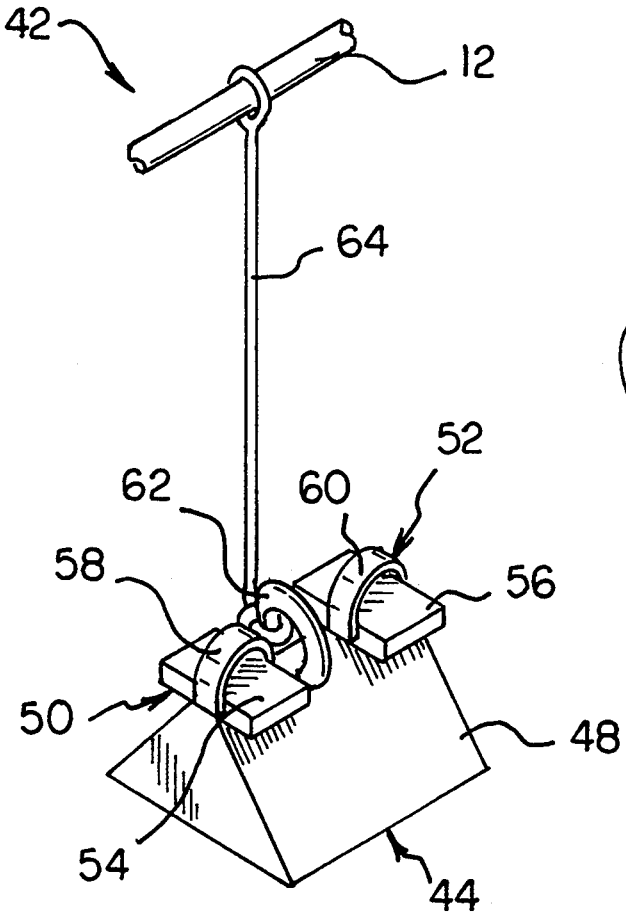
FIG. 4 is a perspective view of a portion of a second embodiment of the present invention.
Figure 5:
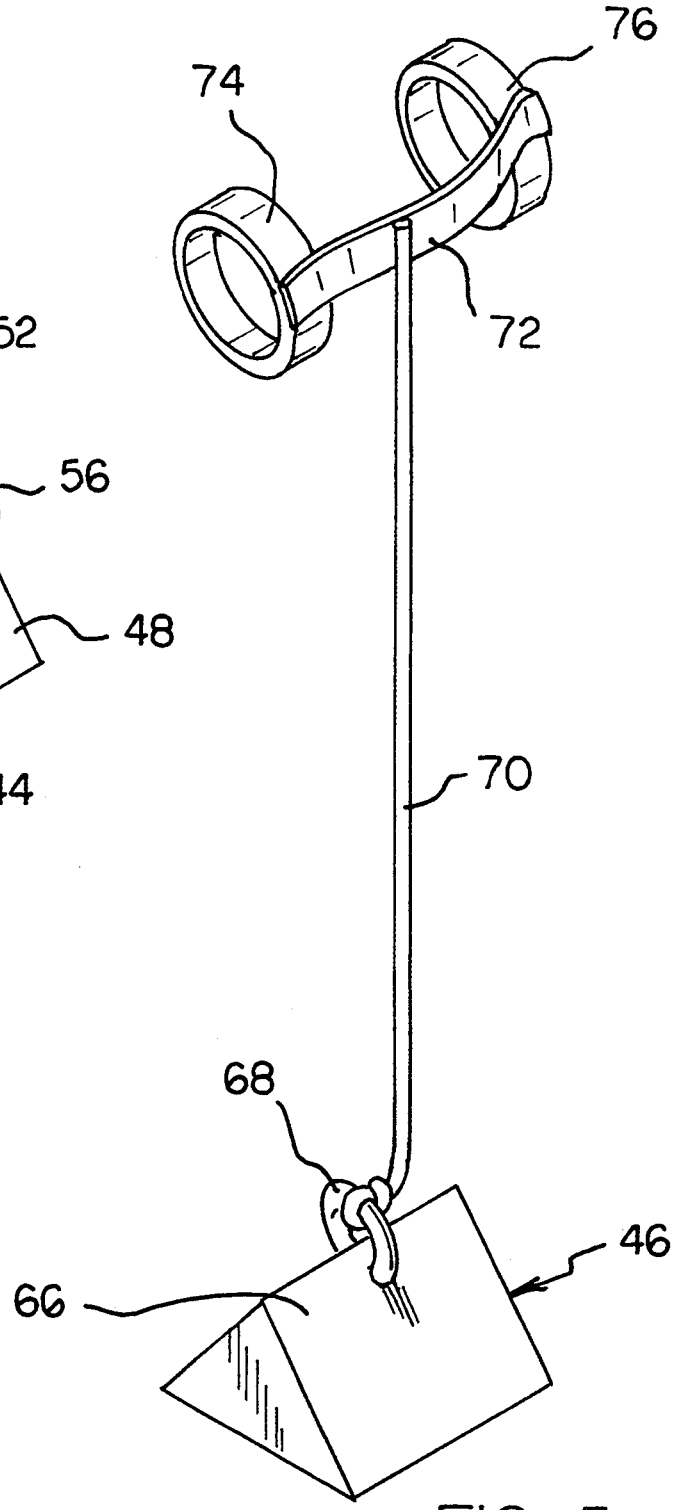
FIG. 5 is a perspective view of a further portion of the second embodiment.

A second embodiment of the present invention as generally designated by the reference numeral 42, which comprises substantially all of the features of the foregoing embodiment 10 and which further comprises a bar anchor assembly 44 and a user anchor assembly 46 will now be described. As best shown in FIGS. 4–5, it can be shown that the bar-anchor assembly 44 comprises a weight 48 that may be placed on a bottom area of a body of water. The weight 48 supports a pair of foot hold assemblies 50, 52 upon which a user may stand. The foot hold assemblies 50, 52 comprise foot blocks 54, 56 which are pivotally or otherwise secured to the weight 48 in a well understood manner. A pair of foot straps 58, 60 are secured to the foot blocks 54, 56, respectively. Connected to a center area of the weight 48 is an eyelet 62 which is operable to secure a bar tether 62 thereto. The bar tether 62 may then be attached by the user to a center area of the bar 12 to retain the buoyancy chambers 14, 16 under water. The bar anchor assembly 44 allows a user to remain positioned within the body of water as well as to retain the bar 12 and its associated buoyancy chambers 14, 16 proximate thereto.

The user anchor assembly 46 may be utilized for holding a user in a selected position within a body of water. The user anchor assembly 46 comprises a further weight 66 which has a further eyelet 68 fixedly secured thereto. A user tether 70 is coupled to the further eyelet 68 and to a center member 72. The center member 72 supports a pair of arm loops 74, 76 in which a user's arms (not shown) may pass through in a well understood manner. The further weight 66 may then be selectively positioned upon a bottom area of the body of water for retaining a position of the user. The user anchor assembly 46 is useful to prevent the user from rising to a surface of the body of water while exercising.

Figure 6:
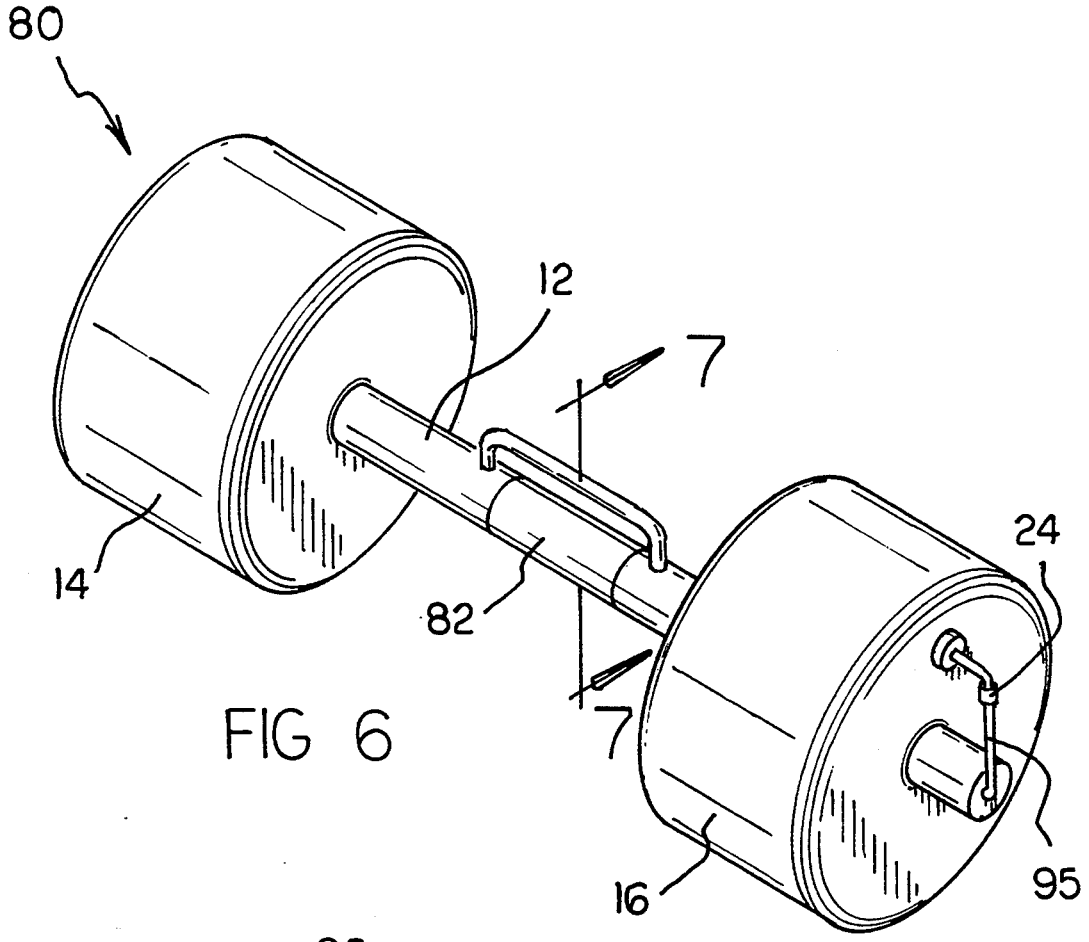
FIG. 6 is a perspective view of a third embodiment of the present invention.
Figure 7:
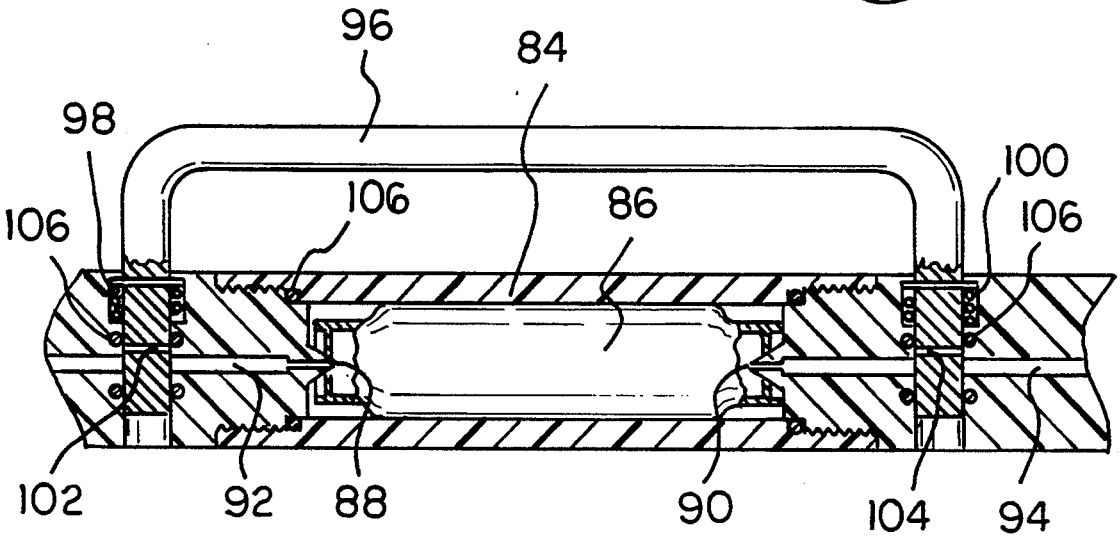
FIG. 7 is a cross-sectional view taken along line 7—7 of FIG. 6.

Comprising all of the features and structure of the previous embodiments 10, 42 is a third embodiment which is generally designated by the reference numeral 80 and may be viewed in FIGS. 6–7. It can be shown that the third embodiment 80 further comprises an internal gas supply 82 which may be selectively operated by a user to inflate the buoyancy chambers 14, 16, thereby increasing a size of the chambers resulting in an increased buoyancy thereof. The gas supply 82 is located in a center area of the bar 12 and is comprised of a center tube 84 which receives and encloses a pressurized gas cartridge 86. A pair of piercing tips 88, 90 pierce the pressurized gas cartridge 86 to provide fluid communication between the pressurized gas cartridge and a pair of gas channels 92, 94, respectively, located within the bar 12. The gas channels 92, 94 extend from the pressurized gas cartridge 86 along an axial length of the bar 12 to respectively opposed ends (not labeled) of the bar 12. A tube 95 completes fluid communication between the gas channel 94 and the inflating assembly 24 of the buoyancy chamber 16, as best illustrated in FIG. 6. A similar tube (not illustrated) connects the gas channel 92 to the inflating assembly 22 of the buoyancy chamber 14. A substantially u-shaped handle 96 is supported upon a pair of coil springs 98,100 within the bar 12. The handle 96 is operable to interrupt fluid communication through the gas channels 92, 94 to prevent gas from the pressurized gas cartridge 86 from passing therethrough. A user may selectively operate the handle 96 to allow a passage of gas through the gas channels 92, 94 by moving the handle in such a manner so as to allow gas from the pressurized gas cartridge 86 to pass through a pair of apertures 102,104 in the handle 96, as best illustrated in FIG. 7. A user may then selectively inflate the buoyancy chambers 14, 16 in a readily apparent manner. A plurality of seals 106 are located throughout the gas supply 82 in a conventional manner to prevent an unintentional release of gas from the pressurized gas cartridge 86.

As to a further discussion addressing the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An underwater buoyant exercise apparatus comprising:

an elongated bar having a center portion, and a first end spaced from a second end, with a first circumferential journal extending around said bar proximal to said first end thereof, and a second circumferential journal extending around said bar proximal to said second end thereof;

a first collar secured on said bar between said center portion and said first circumferential journal;

a second collar secured on said bar between said center portion and said second circumferential journal;

a first buoyancy chamber positioned on said bar between said first collar and said first end of said bar;

a second buoyancy chamber positioned on said bar between said second collar and said second end of said bar;

a first clasp positioned on said bar having a member and engaged to said first journal, said first clasp being pivotally openable;

a second clasp positioned on said bar and engaged to said second journal, said second clasp being pivotally openable;

a first cylindrical retainer positioned over said first clasp so as to preclude pivotal opening of said first clasp, thereby locking said first clasp on said bar and capturing said first buoyancy chamber between said first collar and said first clasp;

and, a second cylindrical retainer positioned over said second clasp so as to preclude pivotal opening of said second clasp, thereby locking said second clasp on said bar and capturing said second buoyancy chamber between said second collar and said second clasp.

2. The underwater buoyant exercise apparatus as recited in claim 1, and further comprising a first inflating assembly in fluid communication with said first buoyancy chamber, and a second inflating assembly in fluid communication with said second buoyancy chamber, said inflating assemblies each comprising a stem extending into said buoyancy chamber, said stem being formed of a substantially resilient material such that said stem can be collapsed to preclude flow therethrough, and a clip mounted to said buoyancy chamber, said clip being operable to receive a portion of said stem to clamp to stem closed and preclude fluid communication through said stem.

3. The underwater buoyant exercise apparatus as recited in claim 2, and further comprising a bar anchor assembly coupled to said bar, said bar anchor assembly comprising a weight, a pair of foot hold assemblies coupled to said weight, and a tether attached to said weight and coupled to said bar.

4. The underwater buoyant exercise apparatus as recited in claim 3, wherein said foot hold assemblies each comprise a foot block pivotally mounted to said weight, and a foot strap coupled to opposed sides of said foot block and extending over said foot block.

5. The underwater buoyant exercise apparatus as recited in claim 4, wherein said bar includes a removable center tube for receiving a pressurized gas cylinder, said bar having a first gas channel extending from said center tube to said first end, and a second gas channel extending from said center tube to said second end, said bar further including a first piercing tip for piercing a first end of said pressurized gas cylinder and permitting fluid communication between said pressurized gas cylinder and said first gas channel, and a second piercing tip for piercing a second end of said pressurized gas cylinder and permitting fluid communication between said pressurized gas cylinder and said second gas channel, and further comprising a first tube coupled to both said first end of said bar and said first inflating assembly for providing fluid communication between said first gas channel and said first buoyancy chamber, a second tube coupled to both said second end of said bar and said second inflating assembly for providing fluid communication between said second gas channel and said second buoyancy chamber, and a handle movably mounted to said bar, said handle being substantially U-shaped and having a first end and a second end with said first end projecting into said bar and through said first gas channel and said second end projecting into said bar and through said second gas channel, said first and second ends of said handle each having an aperture extending therethrough, whereby said handle is movable to position said apertures into alignment with said gas channels to permit fluid communication through said gas channels, and further wherein said handle is movable to position said apertures out of alignment with said gas channels to preclude fluid communication through said gas channels.

* * * * *